US005924204A

United States Patent [19]

Lane

[11] Patent Number: 5,924,204

[45] Date of Patent: Jul. 20, 1999

[54] SCRAPER TOOL AND BLADE AND METHOD OF USE

[76] Inventor: Charles Lane, 129 Ardmore Ave., Ardmore, Pa. 19003

[21] Appl. No.: 09/014,375

[22] Filed: Jan. 27, 1998

[51] Int. Cl.[6] ..... A47L 13/08

[52] U.S. Cl. ..... 30/169; 15/236.01

[58] Field of Search ..... 30/169, 172, 171; 15/236.01, 236.03, 236.05, 236.06

[56] References Cited

U.S. PATENT DOCUMENTS

| | | |
|---|---|---|
| D. 43,817 | 4/1913 | Gaisman . |
| 252,822 | 1/1882 | Way . |
| 358,234 | 2/1887 | Vache . |
| D. 366,130 | 1/1996 | Ordonez . |
| 690,839 | 1/1902 | Coyan . |
| 1,489,419 | 4/1924 | Beechlyn . |
| 1,564,247 | 12/1925 | Kilmartin . |
| 1,886,238 | 11/1932 | Scully . |
| 2,494,572 | 1/1950 | Miller . |
| 2,593,307 | 4/1952 | Jacobsen . |
| 3,080,593 | 3/1963 | Wilson . |
| 4,182,000 | 1/1980 | Fairbairn . |
| 4,324,018 | 4/1982 | Olsson . |
| 4,575,936 | 3/1986 | Gringer . |
| 5,056,226 | 10/1991 | Gringer . |
| 5,077,897 | 1/1992 | Jubran et al. . |
| 5,181,292 | 1/1993 | Aghachi . |

FOREIGN PATENT DOCUMENTS

| | | | |
|---|---|---|---|
| 12219 | of 1898 | United Kingdom | 30/167.1 |

*Primary Examiner*—Douglas D. Watts
*Attorney, Agent, or Firm*—Panitch, Schwarze, Jacobs & Nadel, P.C.

[57] ABSTRACT

A hand-held scraper tool having a handle and a blade clamp and having a blade whose cross-section is in the shape of an arrowhead on a shank. The arrowhead shape of the blade has a blunt rear end that is sufficiently thick to deflect scraped material away from contact with the region of the blade clamp gripping the shank, to provide improved scraping efficiency and to minimize damage to the underlying substrate. The method of using the scraper blade and scraper tool is also within the scope of the invention. The invention avoids the problem common to prior art scrapers which are susceptible to chips or pieces of the scraped material becoming jammed between the blade and the gripping jaws of the scraper tool, causing blade misalignment that results in incomplete scraping and/or damage to the underlying substrate.

18 Claims, 4 Drawing Sheets

SCRAPER TOOL AND BLADE AND METHOD OF USE

BACKGROUND OF THE INVENTION

The present invention relates to a manual scraping tool and blade and their use for removing a layer of material such as paint or wallpaper from a planar surface.

Hand-held or manual scraping tools have long been used to remove materials such as paint and wall coverings like wallpaper from walls and other planar surfaces. Commercially available hand-held scraper devices generally have a handle portion and an attached jaw portion in which is clamped or otherwise held a thin metal blade such as a razor blade. With a new blade, such manual scraper tools are highly effective for removing thin layers of material adhered to substrates such as paint or wallpaper without damaging the integrity of the underlying substrate surface.

A drawback to such commercial scrapers is that with continued use, chips or small pieces of the material being removed from the substrate surface become lodged or jammed in the paint scraper between the scraper blade and the jaws, or other clamping pieces, of the scraper tool holding the blade in place. This results in flexing or deformation of the thin metal blade to an extent that damage to the substrate surface often occurs and the blade no longer efficiently scrapes material from the substrate. A common occurrence is that the deflection of the blade, although imperceptibly small, results in gouging or scraping of the substrate surface. In addition, removal of the layer of material being scraped is often incomplete, since the scraper blade no longer contacts the substrate along its entire blade length. As a result, the user must periodically loosen or remove the blade in the scraper tool jaws and clean the area of the scraper tool that grips the blade to remove or dislodge the chips and small pieces of material causing the problems. If the blade shows signs of being permanently damaged, a replacement blade must also be inserted into the scraping tool before reuse.

In the removal of some materials such as brittle paint layers, the chips and pieces of dislodged material become jammed between the scraper blade and scraper tool jaws with such frequency that periodic cleaning is futile, since the tool scraping effectiveness is severely reduced almost immediately.

Although the problem of chips and pieces of the scraped material becoming lodged or jammed in the paint scraper tool around the scraper blade may at first glance appear to be a minor problem, this drawback to commercial scraper tools currently being marketed represents a significant impediment to the efficient use of such tools.

A need therefore exists for a scraper tool and blade design that overcomes these drawbacks of prior art hand-held scraper tools.

BRIEF SUMMARY OF THE INVENTION

One aspect of the present invention is a hand held scraper tool having a handle attached to a blade clamp and a blade, generally rectangular in outline and having a sharp straight edge on one long side edge of the blade and having an opposite long side edge gripped by the blade clamp, the blade having a cross section between the two long side edges which is generally in the shape of an arrowhead on a shank, the sharp straight edge of the blade forming a point on the arrowhead and the shank being the portion of the blade gripped by the blade clamp, wherein the arrowhead shape of the blade has a blunt rear end that thicker than the thickness of a region of the blade clamp gripping the blade shank portion of the blade to deflect scraped material away from contact with the region of the blade clamp gripping the blade shank portion.

Another aspect of the invention is a method of removing material from a planar surface that comprises scraping a planar surface having a layer of material thereon to dislodge at least a portion of the material layer by using the scraper tool of this invention, wherein the sharp straight edge of the blade is used for scraping a layer of material from the planar surface and the arrowhead blunt rear end of the blade deflects scraped material away from contact with the region of the blade clamp gripping the blade shank portion.

Still another aspect of this invention is a scraper blade that comprises a substantially planar metal blade generally rectangular in outline and having a razor edge on a front side edge of the blade, an opposite rear long side edge of the blade serving as a shank portion of the blade adapted for being gripped in blade gripping jaws of a scraping tool, said planar metal blade having a hard nonmetallic material adhered on at least one blade surface adjacent to the razor edge wherein the hard material is tapered in thickness, having a gradually increased thickness rearwards of the razor edge and terminating abruptly short of the shank portion of the blade, to form an arrowhead shape cross section appearance for the scraper blade.

BRIEF DESCRIPTION OF THE SEVERAL VIEWS OF THE DRAWINGS

The foregoing "Summary of the Invention," as well as the following detailed description of preferred embodiments will be better understood when read in conjunction with the appended drawings. For the purpose of illustrating the invention, there is shown in the drawings an embodiment which is presently preferred, it being understood, however, that the invention is not limited to the specific arrangements and instrumentalities disclosed. In the Drawings.

DETAILED DESCRIPTION OF THE INVENTION

The manual scraping tool and scraper blade of this invention are very efficient at removing layers of material such as paint, wallpaper and the like from flat surfaces such as walls and floors, without causing damage to the underlying substrate during such use of the tool and/or blade. The scraper blade of this invention facilitates deflection of scraped thin layers of material away from the portion of the scraper tool that clamps the shank of the blade, to minimize removed material from becoming lodged or jammed in the scraper tool between the blade shank and the gripping jaws or other clamping member holding the blade in the tool. The present invention thus avoids the problem common to prior art scraper tools of chips or small pieces of scraped material interfering with efficient and damage-free removal of the layered material from the substrate surface being scraped.

Figure 1:
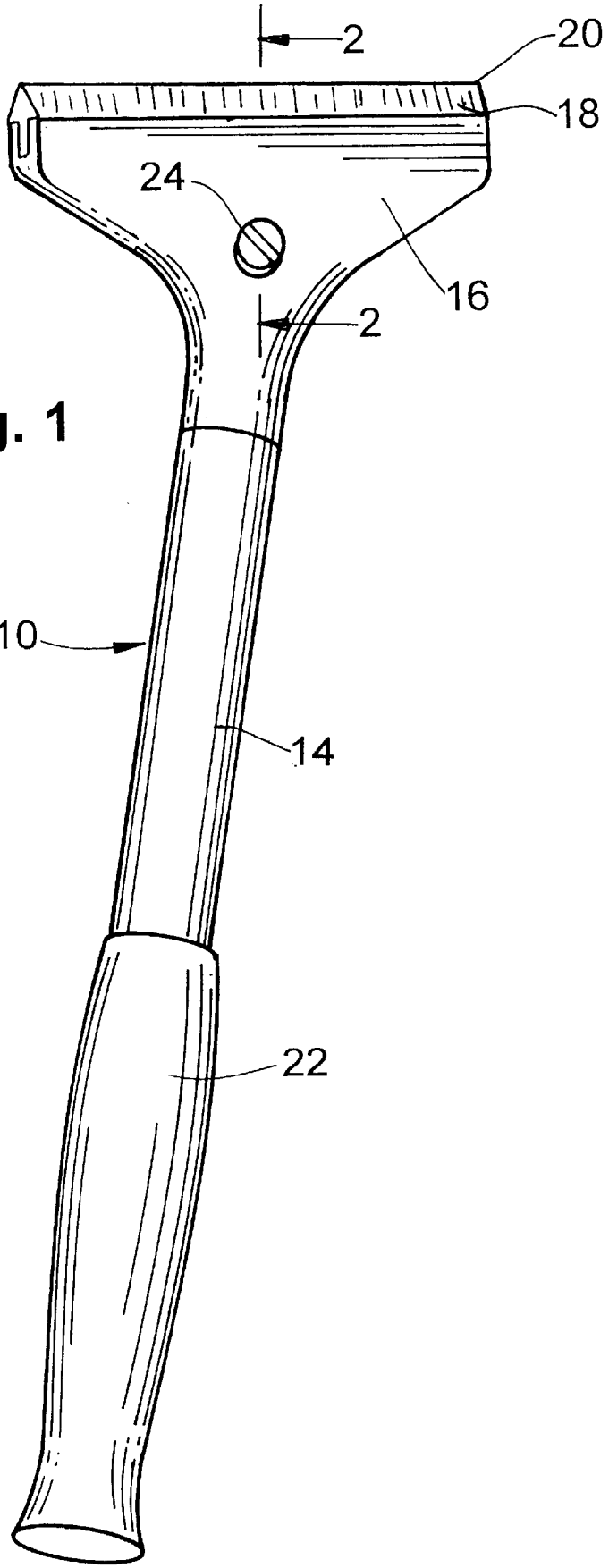
FIG. 1 is a perspective view of a hand-held scraper tool of this invention in which a scraper blade, shown in more detail in FIGS. 3 and 4, is removably mounted in the scraper tool.

A manual scraping tool of the present invention is shown in FIG. 1 in a perspective view, where the tool is identified by the general reference numeral 10. The manual, i.e., hand-held, scraper tool 10 has a handle 14, a blade clamp 16 that is attached to the handle, and a removable blade 18 that is secured and held in the tool by the blade clamp 16. The hand-held scraper tool preferably is generally T-shaped in outline with the handle 14 forming the vertical portion of the T-shape and the blade clamp 16 portion of the tool forming the crossbar portion of the T-shape, as shown in FIG. 1. In the preferred embodiment of the hand-held scraper tool 10 shown in FIG. 1, the handle 14 is an elongated member whose longitudinal axis forms the vertical section of the T-shape, that is slightly offset from being perpendicular with the crossbar portion formed by the blade clamp 16 of the T-shape. This design of the hand-held scraper tool enables the user to remove material more effectively from hard-to-reach places such as comers or the like. However, configurations of a hand-held scraper tool other than the T-shape shown in FIG. 1 are also within the scope of this invention. The elongated handle 14 of the scraper tool 10 shown in FIG. 1 has a nonskid grip 22 made of rubber, plastic or the like and having a relatively non-slippery surface, so that the user's hand may firmly grip the tool 10 during its use to scrape material such as paint, wallpaper or the like from a surface.

The handle 14 is elongated to impart a leveraged mechanical advantage in use of the scraping tool 10. In use, the scraping tool 10 is held in the hand of the user so as to apply the cutting edge 20 of the blade 18 to the wall or other flat surface to be scraped or stripped at a typical angle of approximate 10–30 degrees, relative to the work surface and the longitudinal axis of the handle of the tool. The handle 14 of the tool 10 is typically manipulated to wedge the sharpened edge 20 of the blade 18 under the layer of material being scraped, and the blade is then moved along the surface being scraped to separate the thin layer of material from the supporting flat substrate to which the material was originally adhered.

As shown in FIG. 1, the elements of the tool are substantially all in the same plane (but may be in parallel planes) to maximize scraping efficiency during use of the tool. In other words, a plane formed by the rectangular outline of the blade 18 and a plane formed by the T-shaped outline of the handle 14 and blade clamp 16 are substantially parallel or the same. This arrangement facilitates use of the tool 10 to remove a layer of material such as paint or wallpaper from a planar surface such as a wall, since a manual pushing force moving the blade 18 forward is in the same plane as that formed by the rectangular outline of the blade.

Figure 2:
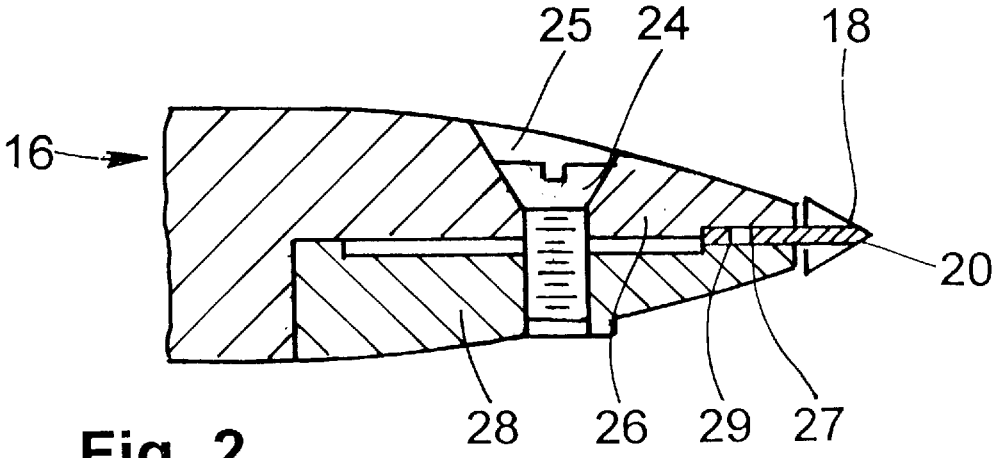
FIG. 2 is an enlarged cross-section view, along the line 2—2 in FIG. 1, of the scraper blade and clamping jaws of the scraper tool shown in FIG. 1.

The scraper blade 18 is readily removable from the hand-held scraper tool 10, and the means by which this is accomplished is shown in FIG. 2. FIG. 2 is a cross-section view, along the line 2—2 in FIG. 1, of the scraper blade 18 and blade clamp 16 of the scraper tool 10. The blade clamp 16 of the tool 10 has a pair of jaws 26, 28 that hold the scraper blade 18 fixed in position in the tool. The two jaws 26, 28 are secured by a threaded bolt 24 that is positioned within a recess 25 in jaw 26 and whose threads mate with corresponding threads in a threaded hole 29 in jaw 28. The threaded screw 24 may be rotated (i.e., unscrewed) to loosen the jaw member 28 and thereby loosen the secured blade 18 from its clamped engagement between the jaws 26 and 28. In this manner, the blade 18 may be replaced with a new blade as needed. Positioning of the blade between the two tapered portions of jaws 26, 28 of the blade clamp 16 is facilitated by a stud 27 extending from the jaw 26 that engages a corresponding hole in the blade 18 to position the blade 18 in a proper orientation. Tightening of the threaded screw 24 by a screwing rotation of the screw 24 causes the blade 18 to be tightly gripped between the two tapered portions of jaws 26 and 28.

The scraper blade 18 of this invention is generally arrowhead shaped in cross-section with the point or tip of the arrowhead corresponding to the sharpened edge 20 of the scraper blade. The rear, or shank portion, of the arrowhead is gripped by the jaws 26, 28 of the tool 10. The sharpened edge 20 of the scraper blade 18 is a honed straight edge that provides the cutting or scraping functionality of the blade during use of the scraper tool 10 to remove a thin layer of material from a substrate. This sharpened straight edge 20 is wedged under the material to be dislodged or removed and the forward motion of the tool 10 in the direction of the arrowhead results in efficient dislodging and removal of the material being scraped.

As shown in FIG. 2 and as discussed in more detail below, the arrowhead cross-section shape of the scraper blade 18 has a blunt rear end at the rear of the arrowhead that is sufficiently thick to deflect scraped material away from contact with the region of the jaws 26 and 28 that clamp the shank of the blade 18.

Figure 3:
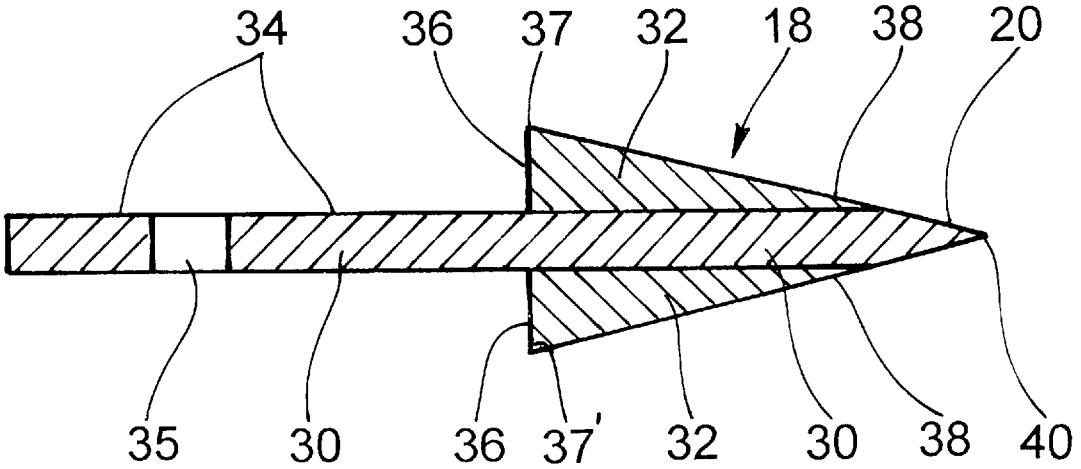
FIG. 3 is a greatly enlarged cross-section view, along the line 3—3 in FIG. 4, of a preferred embodiment of the scraper blade of the present invention.
Figure 3A:
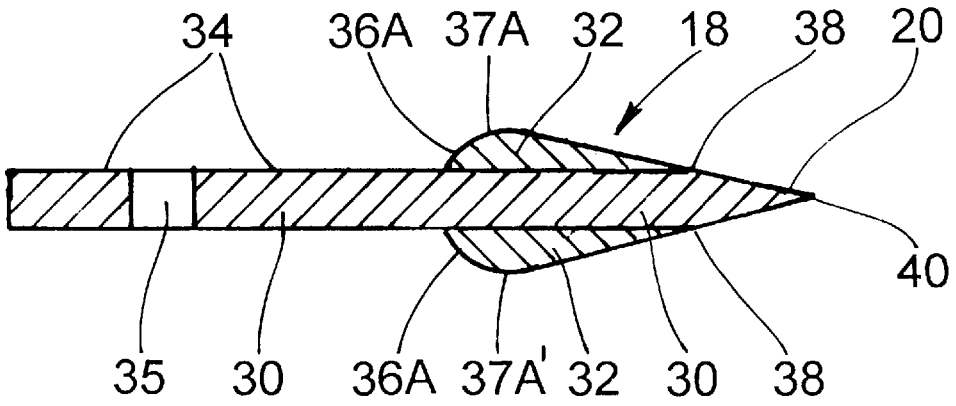
FIG. 3A is a greatly enlarged cross-section view of another preferred embodiment of the scraper blade of the present invention.
Figure 4:
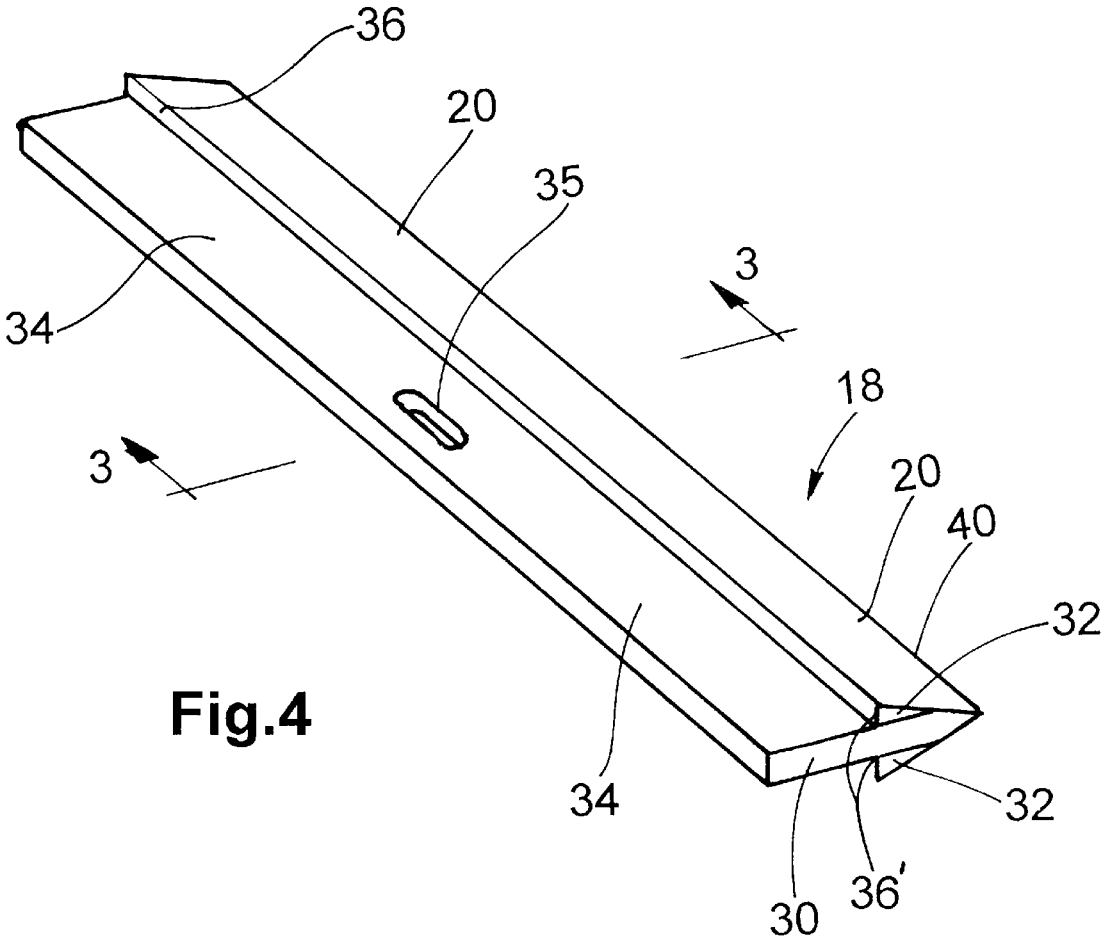
FIG. 4 is an enlarged perspective view of the scraper blade of this invention, shown in cross-section view in FIG. 3.

Several embodiments of the scraper blade of the present invention are shown in FIGS. 3, 3A, 4 and 5. The scraper blade 18 shown in FIG. 3 and in the alternative embodiment in FIG. 3A consists of a metal blade 30 on which is carried a non-metallic hard material 32 that forms the arrowhead shape in the arrowhead-shaped cross-section of the blade 18. FIG. 3 is a cross-section of the scraper blade embodiment shown in FIG. 4, along the line 3—3 in FIG. 4. As is best shown in FIG. 4, the overall blade has a generally rectangular outline in shape.

The metal blade 30 is preferably made of a metal such as steel in a grade that can be honed to a razor-sharp blade edge 20. Other metals besides ferrous metals (razor blade and cutlery grades of steel are preferred) may be used for the blade 30, provided that a suitably sharp cutting edge 20 for the desired scraping applications is possible.

The blade is generally rectangular in outline and has a sharp straight edge 20 along one long side edge of the blade and the opposite long side edge is the shank end 34 of the blade, as shown in FIGS. 3 and 4. The shank 34 of the blade contains a positioning hole 35 that facilitates proper orientation of the scraper blade in the jaws of the blade clamp 16 of the scraper tool 10. The non-metallic material 32 that forms the arrowhead shape of the scraper blade 18 is a hard and durable material that may be a ceramic material or a synthetic resin such as an epoxy resin. Such materials may be applied to the metal blade 30 to form the arrowhead-shaped cross-section by conventional methods such as extrusion or the like. After application, the applied material 32 is thereafter hardened, by thermosetting or heat curing (e.g., for thermosetting resins), high-temperature sintering (e.g., for ceramic materials), catalytically induced curing (e.g., for epoxy resins), or other hardening technique applicable to the selected material. The non-metallic material 32 applied to the metal blade 30 is preferably applied to a continuous metal ribbon that is thereafter cut into appropriately sized blade lengths.

The preferred embodiment of the scraper blade 18 shown in FIG. 3 carries applied material 32 on both sides of the metal blade 30, but it is possible to have the applied material only on one side of the blade 30, such as the top side, which would serve to deflect scraped material that contacts the top side (the bottom side being in contact with the substrate being scraped). The preferred embodiment shown in the drawings has the advantage of deflecting scraped material away from the contact with the region of the blade clamp 16 that grips the blade 18, regardless of which side of the sharpened edge is used to scrape layered material from a substrate.

Referring now to FIG. 3, the applied material 32 that forms the arrowhead shape preferably has a feathered edge 38 where it contacts the metal blade in proximity to the pointed end 40 carrying the sharp edge 20 that serves as the scraping edge of the blade 18. The thickness of the applied material 32 increases in a rearward direction moving away from the pointed end 40 but terminates in a relatively blunt rear portion 36 that forms the blunt back end of the arrowhead. The scraper blade embodiment shown in FIG. 3 has an abrupt termination at the rear of the arrowhead, shown as element 36, such that the arrowhead cross-section has the appearance of a conventional arrowhead. An alternative embodiment is shown in FIG. 3A where the blunt rear end 36A of the arrowhead is more rounded, as compared with the embodiment shown in FIG. 3. The embodiments shown in FIGS. 3 and 3A are each effective for deflecting scraped material dislodged by the pointed end 40 of the respective arrowhead-shaped blades 18 from contact with the region of the gripping jaws 26, 28 (shown in FIG. 2) that grip the blade shank portion 34 of the respective scraper blades in the scraper blade clamp 16.

As is shown in FIG. 4, the overall blade 18 has a generally rectangular outline in shape. The long edge of the blade 18 shown in FIG. 4 may be from about 1 centimeter to about 20 centimeters in length but is preferably from about 2 centimeters to about 10 centimeters in length. Blade shapes other than rectangular, e.g., square, trapezoidal, or the like, are also within the scope of this invention.

The blunt rear end of the arrowhead cross-section of the scraper blade 18 preferably has a thickness that is at least about 30% larger than the thickness of the shank piece 34. More preferably, the blunt rear end of the arrowhead cross-section of the scraper blade 18 has a thickness that is at least about 50% larger than the shank piece, and most preferably at least about 100% larger than the thickness of the shank piece 34. In the embodiment of the scraper blade 18 shown in FIG. 3, the thickness of the blunt end 36 of the arrowhead shape is measured at the point of maximum thickness, of the arrowhead cross-section, the distance between the two points marked with reference 37 and 37'. With respect to scraper blade 18 embodiments such as shown in FIG. 3A, the thickness of the blunt end of the arrowhead shape is measured at the point of maximum thickness, i.e., the distance between the two points marked with reference 37A and 37A' in FIG. 3A.

Figure 5:
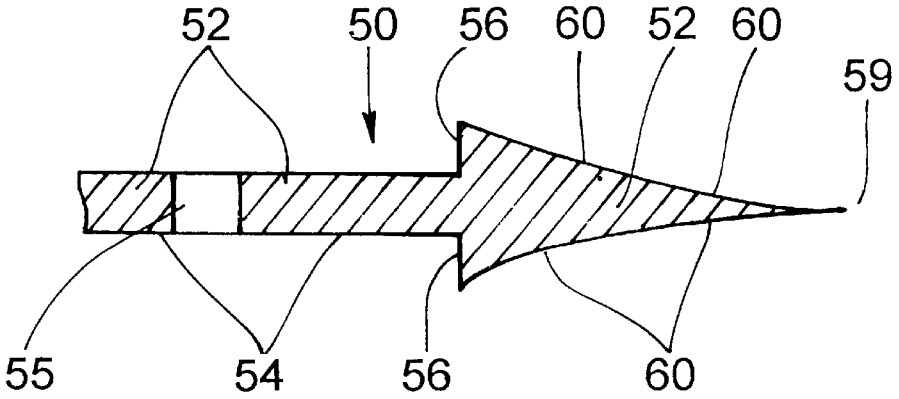
FIG. 5 is a greatly enlarged cross-section view of a second embodiment of the scraper blade of the present invention.

Another embodiment of the scraper blade 18 of the present invention is shown in FIG. 5. The scraper blade is shown generally as 50 and is made of a hard durable material 52 that is preferably conventional blade or cutlery steel, such as carbon steel, but could be made from other metals or a suitable nonmetallic material, e.g., a ceramic material, a synthetic resin, a composite material or the like. The cross-sectional view shown in FIG. 5 depicts the overall arrowhead shape of the scraper blade 50 and shows the shank portion 54 with a positioning hole 55 for orienting the blade 50 in the proper position when installed in the scraper tool. The arrowhead-shaped portion of the blade 50 has a sharp cutting edge at the blade point 58 and a blunt rear end 56 at the rear of the arrowhead shape. In contrast to the embodiments of the scraper blade 18 shown in FIGS. 3 and 3A, the embodiment of the scraper blade 50 shown in FIG. 5 is made entirely of a single material. The scraper blade 50 shown in FIG. 5 may be manufactured by conventional methods typically used to make edged blades for knives, cutlery and the like. The scraper blade 50 may be fabricated from a material other than blade steel such as a ceramic material, a polymeric resin, e.g., a hard plastic material, or a composite material, using manufacturing methods conventionally used with such materials.

The scraper blade 50 shown in FIG. 5 is further characterized by having a concave blade surface between the pointed end 58 and the blunt rear end 56 of the arrowhead cross-section of the blade, and this concave surface 60 facilitates deflection of the scraped layer of material removed from the surface being scraped away from the region of the blade clamp 16 on the scraper tool 10 that grips the blade shank portion 54 of the scraper blade 50. This feature of a concave surface could also be adapted for use with the scraper blade 18 shown in FIGS. 3 and 3A, and such modifications are within the scope of this invention.

The present invention includes the method of removing material from a planar surface by scraping a planar surface using the scraper tool shown in FIG. 1 with any of the blade embodiments shown in FIGS. 3, 3A, 4 and 5. The sharp straight edge 40, 59 of the scraper blade 18, 50 is used for dislodging and scraping a layer of material from a planar surface, i.e., a flat surface such as a wall, floor or window glass, and the blunt rear end of the arrowhead-shaped blade deflects the scraped material away from contact with the region of the blade clamp 16 gripping the blade shank portion. A wide variety of layered or thin materials on various substrates may be scraped, such as paint including layered paint, wallpaper, plaster, sheet flooring, floor tile, rust scale, dirt and the like. The invention is especially useful for scraping old and/or brittle paint layers from a planar substrate. This scraping method consequently avoids the problem common to prior art scraping tools in which the scraped material typically becomes embedded or lodged between the gripping jaws and the shank piece of the gripped blade, leading to scraping inefficiencies and gouging or similar damage to the substrate being scraped.

The scraper tool 10 of the present invention provides efficient scraping functionality, without damage to the underlying substrate from which the scraped material is being removed, when the scraper tool 10 is held at an angle of about 10° to about 30°, measured between the plane of the surface being scraped and the longitudinal axis of the scraper blade 18 arrowhead cross-section. The taper of the blade clamp 16 of the tool 10 near the clamped blade 18 is desirable for preventing this portion of the tool 10 from scraping and damaging the wall as the hand-held tool 10 is moved along a surface to scrape material therefrom.

Use of the scraper blade 50 shown in FIG. 5, having the concave surface between the pointed end 59 and the blunt rear end 56 of the arrowhead portion of the blade 50, is particularly effective for removing scraped material, since the layered material is curled away from contact with the region of the blade clamp 16 that grips the blade shank piece.

Figure 6:
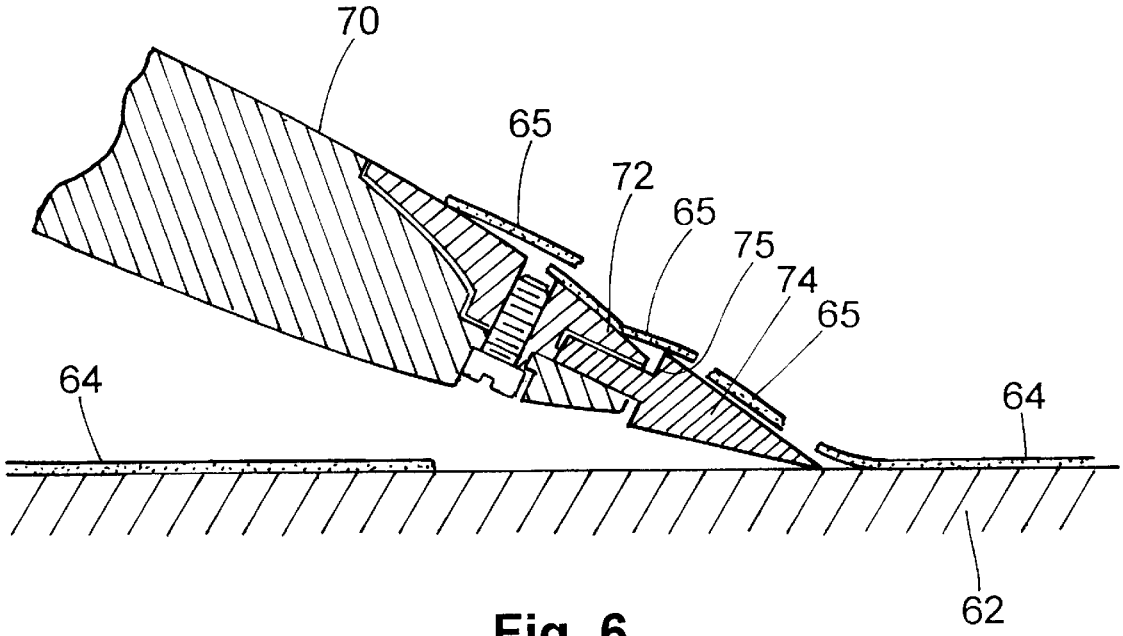
FIG. 6 is a greatly enlarged cross-section view of a scraper blade of this invention, as shown in FIG. 5, mounted in the jaws of a scraper tool of this invention, being used to scrape paint from a surface.

Use of the scraper tool 10 in this invention to remove a thin layer of material on a substrate is depicted in FIG. 6. By way of comparison, use of a prior art scraping tool with a prior art blade to scrape a thin layer of material from a substrate is shown in FIG. 7.

Figure 7:
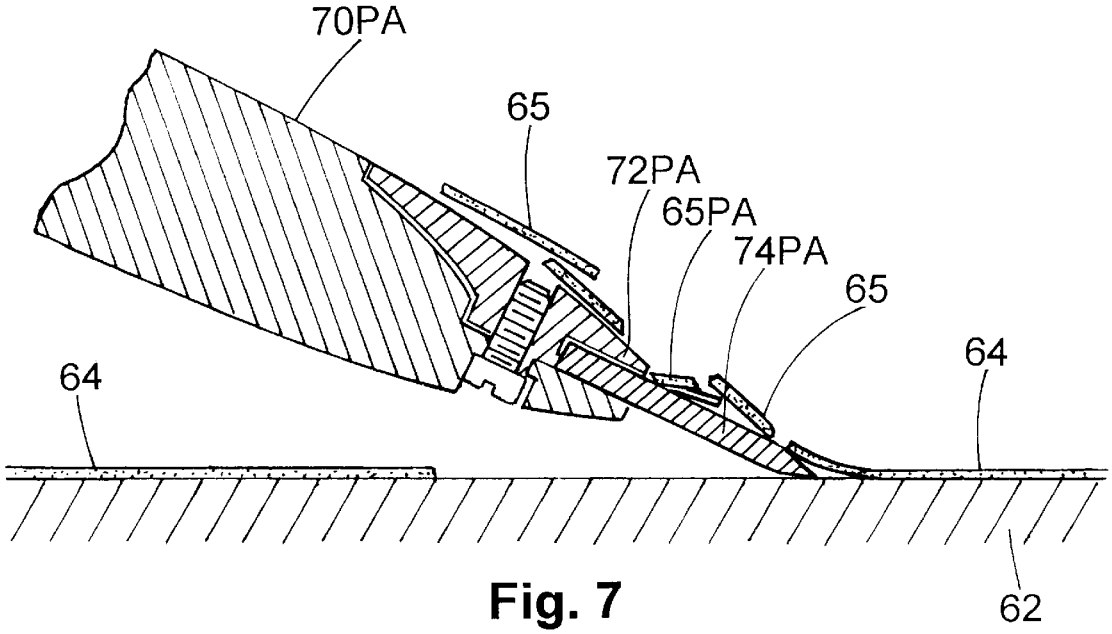
Fig. 7 PRIOR ART
FIG. 7 is a cross-section view of a prior art flat scraper blade mounted in the jaws of a prior art scraper tool, being used to scrape paint from a surface.

In each of FIGS. 6 and 7, a substrate 62 such as a wall, is scraped with a scraping tool (only a portion of the blade clamp 70, 70PA with scraper blades 74, 74PA are shown) to remove a thin layer 64 of material such as paint adhered to or carried on the substrate 62. In FIG. 6 (and likewise in FIG. 7), the view of the blade clamp and scraper blade shown in the drawing is depicted in cross section. As the pointed edge of the arrowhead-shaped blade 74 is used to dislodge the thin layer of adhered material 64 from the substrate, dislodged pieces 65 of the layered material are deflected by the blunt rear end 75 of the arrowhead-shaped blade 74 away from contact with the portion 72 of the blade clamp gripping the shank of the arrowhead-shaped blade 74. The dislodged pieces 65 of layered material are consequently guided in a direction away from possible contact with the gripping portion of the blade clamp 72 in the region proximate to the clamped shank of the scraper blade. The dislodged pieces 65 therefore do not interfere in any manner with the proper orientation or the like of the gripped blade 74 held by the blade clamp 70, so scraping efficiency is excellent. The scraper tool and the gripped scraper blade will continue to provide the desired scraping efficiency, with no damage to the underlying substrate being scraped, until normal wear and tear of the blade cutting edge require that the worn blade be replaced.

In contrast, the prior art scraper tool shown in FIG. 7 has a counterpart blade clamp 70PA that grips a conventional flat scraper blade 74PA. During scraping of the same thin layer of adhered material 64 on the same substrate 62 as shown in FIG. 6, the prior art scraper and scraping blade shown in FIG. 7 is susceptible to dislodged pieces 65 of the layered material 65 becoming jammed, such as shown for chips 65PA between the shank of the blade 74PA and the region of the blade clamp 70PA that grips the blade shank. Even though this gripping portion of the blade clamp 70PA is tapered in the region 72PA adjacent to the clamped blade, chips or pieces 65PA of the dislodged material nevertheless are prone to becoming jammed or lodged between the shank of the blade 74PA and the gripping portion 72PA of the blade clamp in the prior art scraping tool. This jamming of removed chips or pieces of material occurs frequently and requires loosening or removal of the blade from the scraping tool, long before replacement of the blade is required due to normal wear and tear, to avoid damage to the underlying substrate from the misadjusted blade (damage not shown in the Figure) and to insure that the scraped material is cleanly removed from the substrate.

The scraper tool, scraper blade and its use in accordance with the present invention avoid the drawbacks of the prior art scraping devices such as shown in FIG. 7. The improvement provided in scraping efficiency in removal of layered materials from a flat substrate by the present invention is significant since it allows the user of the hand-held scraper tool or other device with the scraper blade of this invention to scrape surface is need of treatment for extended periods, without the need to stop frequently and periodically readjust or clear and clean the blade, as is the case with use of prior art scrapers.

From the foregoing description, it can be seen that the present invention comprises a hand-held scraper tool, a scraper blade useful in such a tool or in other scraping devices, and a method of using such a scraper tool and scraper blade. It will be recognized by those skilled in the art that changes may be made to the above-described embodiments of the invention without departing from the broad inventive concepts thereof. It is understood, therefore, that this invention is not limited to the particular embodiments disclosed but is intended to cover any modifications which are within the scope and spirit of the invention as defined by the appended claims.

I claim:

1. A hand held scraper tool comprising a handle attached to a blade clamp and a blade, generally rectangular in outline and having a sharp straight edge on one long side edge of the blade and having an opposite long side edge gripped by the blade clamp, the blade having a cross section between the two long side edges which is generally in the shape of an arrowhead on a shank, the sharp straight edge of the blade forming a point on the arrowhead and the shank being the portion of the blade gripped by the blade clamp, wherein the arrowhead shape of the blade has a blunt rear end that is thicker than the thickness of a region of the blade clamp gripping the blade shank portion of the blade to deflect scraped material away from contact with the region of the blade clamp gripping the blade shank portion.

2. The hand held scraper tool of claim 1 wherein the handle and blade clamp are generally T-shaped in outline with the handle forming a vertical portion of the T-shape and attached to the blade clamp forming a crossbar portion of the T-shape.

3. The hand held scraper tool of claim 1 wherein the blunt rear end of the arrowhead cross section of the blade has a thickness that is at least about 30% larger than a thickness of the shank.

4. The hand held scraper tool of claim 1 wherein the blunt rear end of the arrowhead cross section of the scraper blade has a thickness that is at least about 100% larger than a thickness of the shank.

5. The hand held scraper tool of claim 1 wherein the arrowhead-shaped blade has a concave surface between the pointed end and the blunt rear end of the arrowhead cross section of the blade.

6. The hand held scraper tool of claim 1 wherein the long side edges of the blade are from about 1 cm to about 20 cm in length.

7. The hand held scraper tool of claim 1 wherein the long side edges of the blade are from about 2 cm to about 10 cm in length.

8. The hand held scraper tool of claim 1 wherein the blade is made of a material selected from the group consisting of a metal, a composite material, a ceramic material and a polymeric resin.

9. The hand held scraper tool of claim 2 wherein the handle of the scraping tool is an elongated member, whose longitudinal axis forming the vertical section of the T-shape is slightly offset from being perpendicular with the cross bar portion of the T-shape.

10. The hand held scraper tool of claim 1 wherein the arrowhead-shaped blade has a concave surface between the pointed end and the blunt ear end of the arrowhead portion of the blade, whereby scraped material is curled away from contact with the region of the blade clamp griping the blade shank.

11. A scraper blade comprising a substantially planar metal blade generally rectangular in outline and having a razor edge on a front side edge of the blade, an opposite rear long side edge of the blade serving as a shank portion of the blade adapted for being gripped in blade gripping jaws of a scraping tool, said planar metal blade having a hard nonmetallic material adhered on at least one blade surface adjacent to the razor edge wherein the hard material is tapered in thickness, having a gradually increased thickness rearwards of the razor edge and terminating abruptly short of the shank portion of the blade, to form an arrowhead shape cross section appearance for the scraper blade.

12. The scraper blade of claim 11 wherein the hard nonmetallic material is selected from the group consisting of a composite material, a ceramic material and a polymeric resin.

13. The scraper blade of claim 11 wherein the hard nonmetallic material forming the arrowhead shape has a concave surface between the arrowhead pointed end and the arrowhead rear end.

14. The scraper blade of claim 11 wherein the rear end of the arrowhead shape has a thickness that is at least about 30% larger than the thickness of the metal blade.

15. The scraper blade of claim 11 wherein the rear end of the arrowhead cross section shape has a thickness that is at least about 100% larger than the thickness of the metal blade.

16. The scraper blade of claim 11 wherein the long side edges of the scraper blade are from about 1 cm to about 20 cm in length.

17. The scraper blade of claim 11 wherein the long side edges of the scraper blade are from about 2 cm to about 10 cm in length.

18. The scraper blade of claim 11 wherein the arrowhead shape cross section appearance has a rounded shape rearwards of the razor edge where the increased tapered thickness of the hard material terminates short of the shank portion of the blade.

* * * * *